US010551070B2

(12) United States Patent
Park

(10) Patent No.: US 10,551,070 B2
(45) Date of Patent: Feb. 4, 2020

(54) HOME APPLIANCE

(71) Applicant: Samsung Electronics Co., Ltd., Suwon-si (KR)

(72) Inventor: Wan Gi Park, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 262 days.

(21) Appl. No.: 15/666,988

(22) Filed: Aug. 2, 2017

(65) Prior Publication Data

US 2018/0292094 A1 Oct. 11, 2018

(30) Foreign Application Priority Data

Apr. 7, 2017 (KR) ..... 10-2017-0045398

(51) Int. Cl.
*F24C 15/00* (2006.01)
*F24C 15/02* (2006.01)

(52) U.S. Cl.
CPC ..... *F24C 15/023* (2013.01); *F24C 15/024* (2013.01)

(58) Field of Classification Search
CPC .... F24C 15/023; F24C 15/024; F24C 15/022; F24C 15/04; F24C 15/02; F24C 15/021; E05B 63/20; E05B 53/00; A47L 15/4259
See application file for complete search history.

(56) References Cited

U.S. PATENT DOCUMENTS 6,698,418 B2 * 3/2004 Ramsey ..... F24C 15/022 126/19 R
7,556,033 B2 * 7/2009 Kim ..... F24C 15/022 126/197
2014/0035453 A1 2/2014 Kwon et al.

FOREIGN PATENT DOCUMENTS

EP 0 659 960 A2 12/1994
EP 1 431 671 A1 6/2004
EP 1 887 170 A1 2/2008
KR 1991-0000720 2/1991

* cited by examiner

*Primary Examiner* — Alfred Basichas
(74) *Attorney, Agent, or Firm* — Staas & Halsey LLP

(57) ABSTRACT

Disclosed is a home appliance including a latch for a door having an improved structure. The home appliance includes a main body having a cavity, a door rotatably coupled to the main body to open and close the cavity, a latch having a locking portion provided to fix the door to the main body and a leg provided to rotate the locking portion in a first direction, and an elastic member coupled to the latch to elastically bias the locking portion in a second direction.

19 Claims, 12 Drawing Sheets

HOME APPLIANCE

CROSS-REFERENCE TO RELATED APPLICATIONS

This application claims the priority benefit of Korean Patent Application No. 10-2017-0045398, filed on Apr. 7, 2017, in the Korean Intellectual Property Office, the disclosure of which is incorporated herein by reference.

BACKGROUND

1. Technical Field

The present disclosure relates to a home appliance, and more particularly, to a home appliance including a door latch having an improved structure.

2. Description of the Related Art

Home appliances having a cavity, such as an oven, a cooking apparatus, a dishwasher, a refrigerator and a washing machine, include a door to enable a user to open or close the cavity. The door includes a handle to allow the user to open or close the door with his/her hand, and the handle protrudes from the door or is in the shape of a groove recessed from the door.

Generally, the door includes a latch interworking with an opening or closing movement of the door to give a user convenience when he/she puts objects into the cavity or takes objects out of the cavity. The latch moves within a predetermined angle range according to a movement of the door.

When the door opens, the latch is embedded in the door to be parallel to the rear side of the door, and when the door is closed, the latch moves to a position that is perpendicular to the rear side of the door. When the door is completely closed, the latch fixes the door at a main body by a catch provided in the main body.

Therefore, when a user opens the door in order to use the home appliance, the users finger may get caught between the latch rotating according to a movement of the door and the rear side of the door, resulting in injury.

Generally, the latch includes a leg that is pressed by a pressing portion provided on a link member connecting the door to the main body so that the latch can rotate according to a movement of the door.

Since the pressing operation of the pressing portion against the leg is mechanical operation, the user may have difficulties in rotating the latch rotating according to a movement of the door in the reverse direction by an external force.

Accordingly, if the user's finger gets caught between the latch and the rear side of the door when the user opens the door, it may be hard for the user to rotate the latch in a direction that is opposite to the rotation direction of the latch by an external force and take out the user's finger in order to reduce injury of the finger.

SUMMARY

Therefore, it is an aspect of the present disclosure to provide a home appliance including an improved door wherein an angle of rotation of a latch for fixing the door changes according to a degree of opening or closing of the door.

It is another aspect of the present disclosure to provide a home appliance including an improved door having a leg and an elastic member, wherein the leg enables a latch rotating according to a movement of the door to rotate in the reverse direction, and the elastic member is coupled with the latch.

It is another aspect of the present disclosure to provide a home appliance including an improved door in which an elastic member coupled with a latch is accommodated in a link housing.

Additional aspects of the disclosure will be set forth in part in the description which follows and, in part, will be obvious from the description, or may be learned by practice of the disclosure.

In accordance with an aspect of the present disclosure, a home appliance includes a main body having a cavity, a door rotatably coupled to the main body to open or close the cavity, a latch including a locking portion configured to fix the door to the main body and a leg configured to rotate the locking portion in a first direction, and an elastic member coupled to the latch to elastically bias the locking portion in a second direction.

The latch may further include an elastic member coupling portion to which the elastic member is coupled, and the home appliance may further include a link housing configured to accommodate the elastic member coupled to the elastic member coupling portion and at least a portion of the latch.

The locking portion may be provided to rotate between a locking position substantially perpendicular to a rear surface of the door and a hidden position substantially parallel to the rear surface of the door.

The first direction may be a direction in which the locking portion moves toward the locking position, and the second direction may be a direction in which the locking portion moves toward the hidden position.

The elastic member may include a torsion spring.

The home appliance may further include a link rod configured to linearly move with respect to the door and including a pressing portion configured to press and rotate the latch.

The locking portion may be rotated by the leg when the door is closed and may be rotated by the elastic member when the door is opened.

The pressing portion may support the leg such that an angle of rotation of the locking portion increases gradually according to a rotation of the door.

The leg may be configured such that the locking portion is rotatable in the first direction while rotating in the second direction.

The link rod may further include a first link rod having one side coupled to the main body and a second link rod having one side coupled to the latch, and the other side of the first link rod and the other side of the second link rod may be rotatably coupled to each other.

The first link rod may be configured to be rotated with respect to the main body, the second link rod may be configured to linearly move with respect to the door according to the rotation of the first link rod, and the latch may be configured to rotate according to the linear movement of the second link rod.

The home appliance may further include a first joint rotatably coupling the door to the main body, a second joint rotatably coupling the first link rod to the main body, a third joint rotatably coupling the second link rod to the first link rod, and a fourth joint rotatably coupling the latch to the door.

A position of the first joint and a position of the second joint may be different from each other such that an angle of rotation of the first link rod is larger than an angle of rotation of the door.

The elastic member may include a tension spring.

One side of the tension spring may be coupled to a first spring hole provided at one end of the leg and the other side of the tension spring may be coupled to a second spring hole provided at a portion of the link housing disposed adjacent to the first spring hole.

In accordance with another aspect of the present disclosure, a home appliance includes a main body having a cavity, a door configured to open or close the cavity, a link unit accommodated in the door such that the door is rotatably coupled to the main body. The link unit may include a latch configured to fix the door to the main body and to rotate according to a rotation of the door with respect to the main body, and a link rod configured to be linearly movable and including a pressing portion configured to press and rotate the latch. The latch may include a leg configured to allow a rotation of the latch in a first direction and to restrict a rotation of the latch in a second direction by the pressing portion.

The link unit may further include an elastic member elastically biasing the latch to rotate the latch in the second direction.

The elastic member may be coupled to the latch and disposed in a link housing receiving the link rod with the latch.

In accordance with another aspect of the present disclosure, a home appliance includes a main body having a cavity, a door rotatably coupled to the main body to open or close the cavity, a latch coupled to the door and configured to rotate according to a rotation of the door with respect to the main body, and an elastic member coupled to the latch and configured to transmit an elastic force to the latch so as to rotate. The latch may include a latch body including a latch hole through which the latch is coupled to the door, a locking portion provided to fix the door to the main body, and an elastic member coupling portion extending in an axial direction from one end of the latch body and to which the elastic member is coupled, and a leg extending from a periphery of the latch body.

The home appliance may further include a link rod including a pressing portion configured to press the latch to rotate the locking portion. The leg may include a contact portion that is opposite to the locking portion with respect to the pressing portion to be in contact with the pressing portion, and another portion that faces the contact portion and opens with the pressing portion in between.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
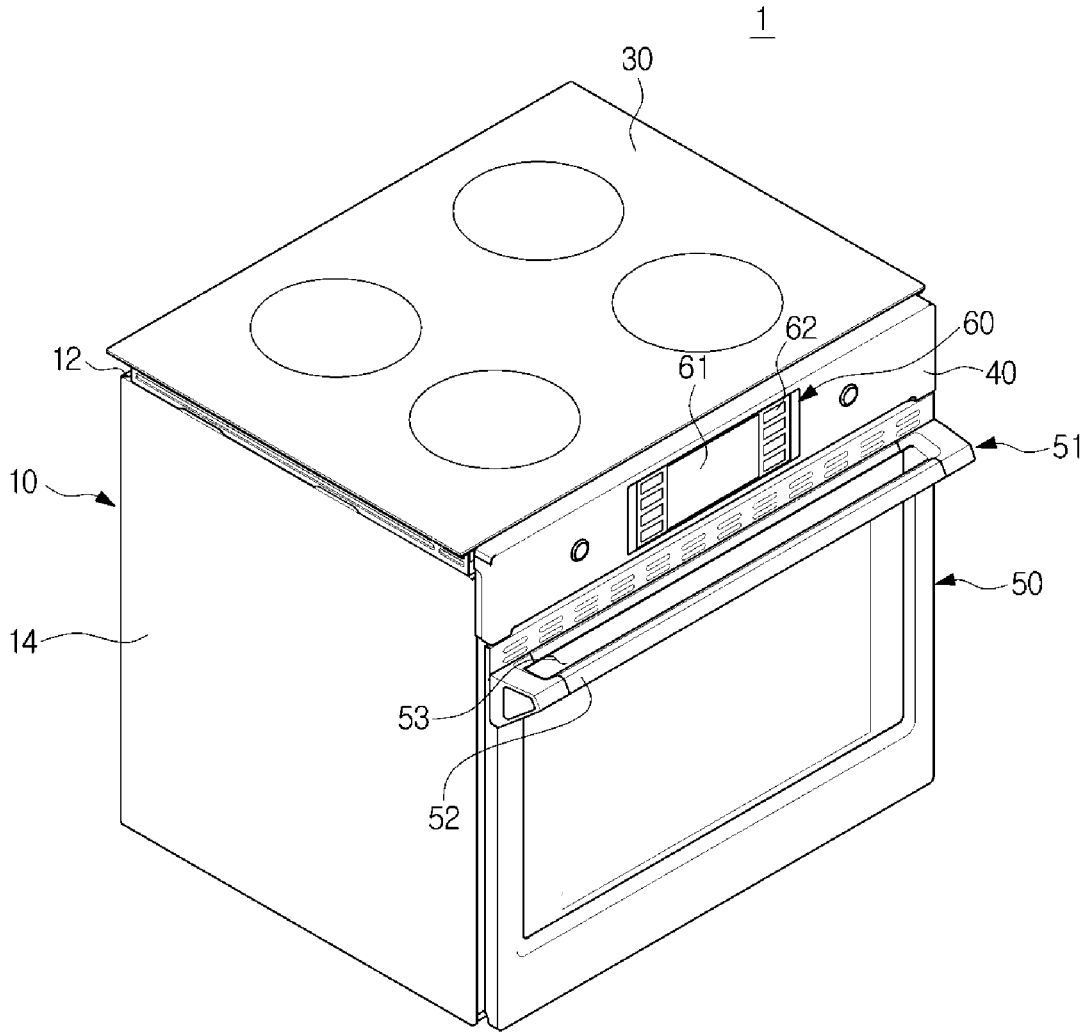
FIG. 1 is a perspective view of a home appliance according to an embodiment of the present disclosure.

Configurations illustrated in the embodiments and the drawings described in the present specification are only the preferred embodiments of the present disclosure, and thus it is to be understood that various modified examples, which may replace the embodiments and the drawings described in the present specification, are possible when filing the present application.

Also, like reference numerals or symbols denoted in the drawings of the present specification indicate elements or components that perform the substantially same functions. Also, the terms used in the present specification are for describing embodiments and not for limiting or restricting the present disclosure.

It is to be understood that the singular forms "a," "an," and "the" include plural referents unless the context clearly dictates otherwise. It will be understood that the terms "includes," "comprises," "including," and/or "comprising," when used in this specification, specify the presence of stated features, figures, steps, components, or combination thereof.

Therefore, they do not preclude the presence or addition of one or more other features, figures, steps, components, members, or combinations thereof.

It will be understood that, although the terms first, second, etc. may be used herein to describe various components, these components should not be limited by these terms. These terms are only used to distinguish one component from another.

For example, a first component could be termed a second component, and, similarly, a second component could be termed a first component, without departing from the scope of the present disclosure.

As used herein, the term "and/or" includes any and all combinations of one or more of associated listed items.

Meanwhile, in the following description, the terms "front", "rear", "upper portion", "lower portion", etc. are defined based on the drawings, and do not intend to limit shapes and locations of individual components.

Hereinafter, exemplary embodiments according to the present disclosure will be described in detail with reference to the accompanying drawings.

Figure 2:
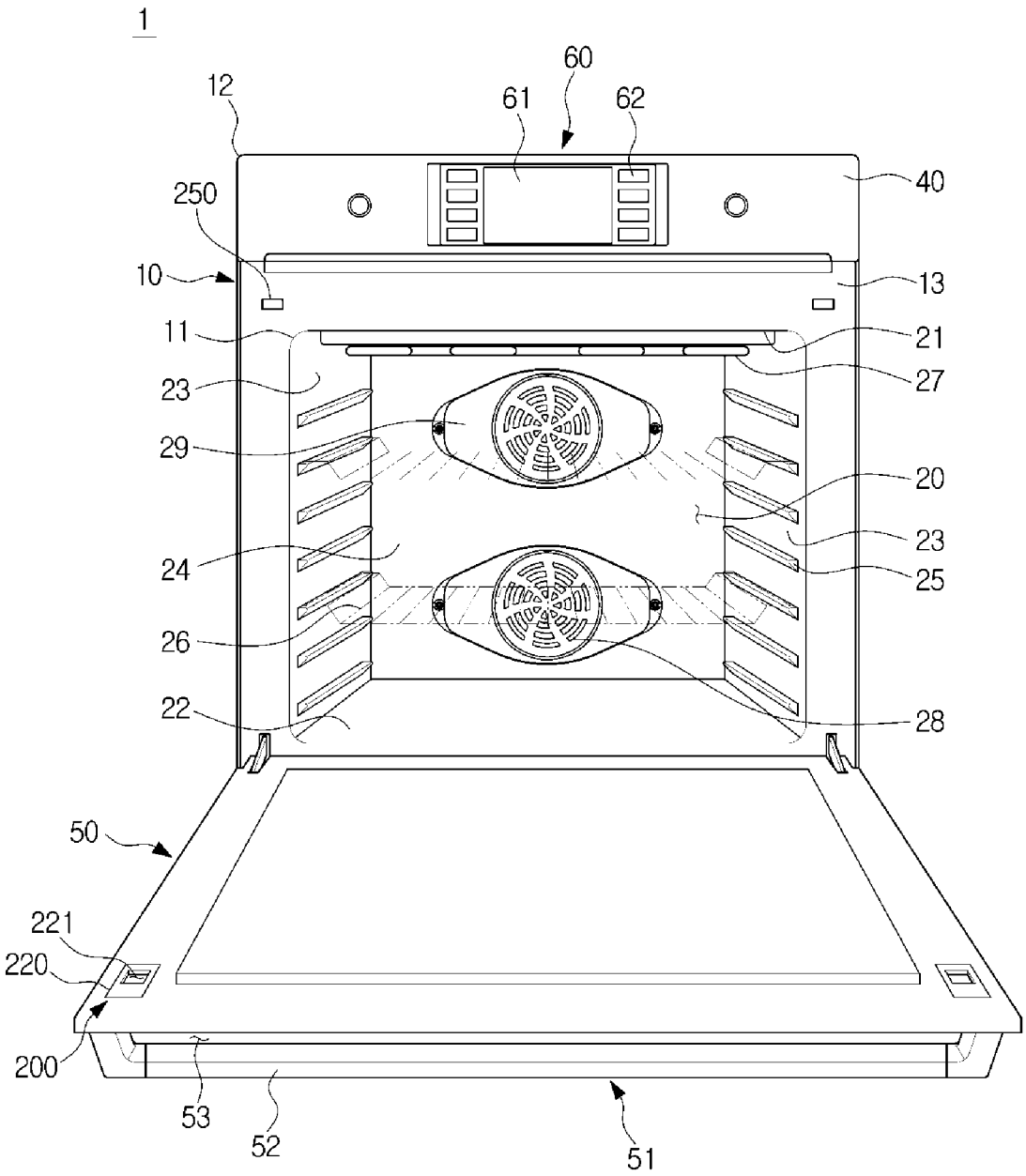
FIG. 2 is a front view of the home appliance according to the embodiment of the present disclosure when a door opens.
Figure 3:
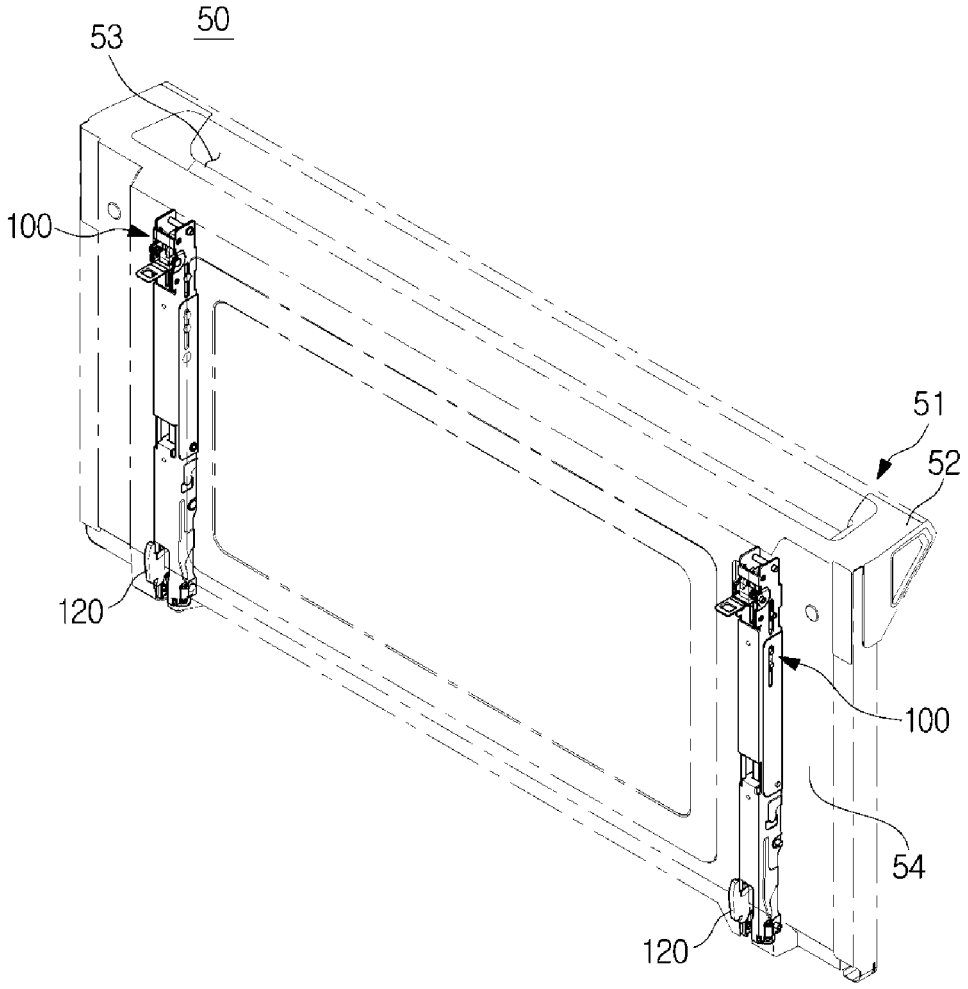
FIG. 3 is a perspective view schematically illustrating a rear portion of the door of the home appliance according to the embodiment of the present disclosure.
Figure 4:
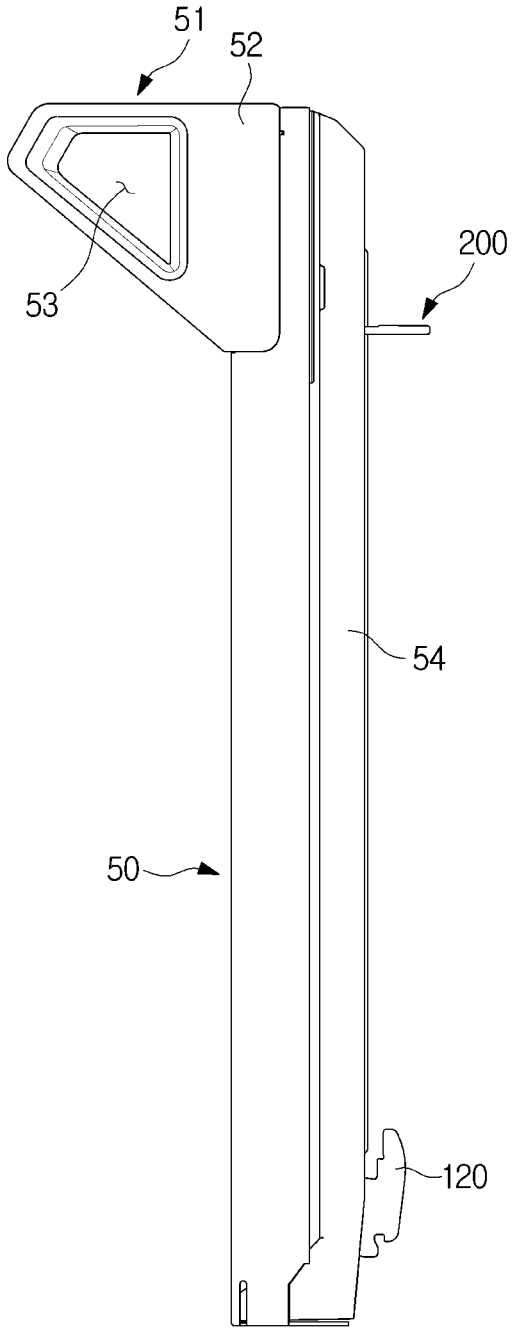
FIG. 4 is a side view schematically illustrating a side portion of the door of the home appliance according to the embodiment of the present disclosure.

FIG. 1 is a perspective view of a home appliance according to an embodiment of the present disclosure, FIG. 2 is a front view of the home appliance according to the embodiment of the present disclosure when a door opens, FIG. 3 is a perspective view schematically illustrating a rear portion of the door of the home appliance according to the embodiment of the present disclosure, and FIG. 4 is a side view schematically illustrating a side portion of the door of the home appliance according to the embodiment of the present disclosure.

As illustrated in FIGS. 1 to 4, a home appliance 1 may include a main body 10 having an inner case 11 in which a cavity 20 is formed and an outer case 12 coupled to the outer portion of the inner case 11 and forming an outer appearance of the home appliance 1.

In FIG. 1, an oven is shown as an example of the home appliance 1, however, the home appliance 1 is not limited to the oven. The home appliance 1 may be a microwave, a dishwasher, a refrigerator, a washing machine, or the like, as long as it has a main body forming a cavity therein and a door for opening and closing the cavity. Hereinafter, the present disclosure will be described under an assumption that the home appliance 1 is an oven.

Generally, the oven is a cooking apparatus including a cavity, a heating device for applying heat to the cavity, and a circulation fan for circulating heat generated by the heating device inside the cavity.

The oven heats and cooks food in a sealed cavity. Generally, the oven can be classified into an electric oven, a gas oven, and an electronic oven (also cared a microwave) depending on the type of a heat source. The electric oven uses an electric heater as a heat source, the gas oven uses heat generated by gas as a heat source, and the microwave oven uses frictional heat of water molecules generated by high frequency as a heat source.

The inner case 11 and the outer case 12 of the home appliance 1 according to the present disclosure may be in the shape of a box whose front side opens. The home appliance 1 may include a cooktop 30 disposed on the top of the home appliance 1 to heat a container containing food thereon.

The home appliance 1 may include a door 50 disposed in a front portion of the main body 10 to open or close the cavity 20.

The outer case 12 may include a front panel 13 forming the front portion of the main body 10, side panels 14 forming side portions of the main body 10, and a rear panel (not shown) forming a rear portion of the main body 10.

In the front upper portion of the front panel 13, a machine room cover 40 may be disposed to cover a machine room (not shown). On the machine room cover 40, a display module 60 may be mounted.

The cavity 20 formed in the inside of the main body 10 in the shape of a box whose front portion opens may be defined by an upper plate 21, a bottom plate 22, side plates 23, and a rear plate 24. The cavity 20 may have an opening in the front portion to allow a user to put food into the cavity 20 or take food out of the cavity 20.

On the inner surfaces of the side plates 23, a plurality of support bars 25 may be provided. At least one removable rack 26 to put food thereon may be placed on the plurality of support bars 25.

The plurality of support bars 25 may include rails (not shown) on which the at least one rack 26 can slide. A user may move the rack 26 through the rails (not shown) to take food out of the rack 26 or put food on the rack 26.

A divider (not shown) for dividing the cavity 20 into a plurality of cavities 20 may be detachably mounted on the plurality of support bars 25. The cavities 20 divided by the divider may have different sizes.

Accordingly, the user may utilize the spaces of the plurality of cavities 20 in various ways according to his/her intention. The divider may be made of an insulating material to insulate the individual cavities 20.

In the cavity 20, a heater 27 may be installed to heat food. The heater 27 may be an electric heater including an electric resistor. However, the heater 27 is not limited to the electric heater, and may be a gas heater that generates heat by burning gas.

In the rear plate 24 of the cavity 20, a circulation fan 28 for circulating air in the cavity 20 to heat food evenly, and a circulation motor (not shown) for driving the circulation fan 28 may be provided.

A circulation fan cover 29 for covering the circulation fan 28 may be disposed in front of the circulation fan 28. A plurality of holes (not shown) may be formed in the circulation fan cover 29 to pass air.

The front opening of the cavity 20 may be opened and closed by the door 50, and the door 50 may be hinged to a lower portion of the main body 10 in such a way to be rotatable with respect to the main body 10.

In the home appliance 1 according to the present disclosure, the cavity 20 may have a front opening, and the door 50 may be provided in front of the cavity 20 to open and close the front opening of the cavity 20.

However, the cavity 20 may have an upper opening, and the door 50 may be provided above the cavity 20 to open and close the upper opening of the cavity 20.

In the home appliance 1 according to the present disclosure, the door 50 may be a pull-down type door which rotates, when the door 50 is pulled, with respect to a rotation axis of the lower portion of the main body 10 to fall downward. However, the door 50 may be a pull-side type door which opens and closes in a left-right direction.

The main body 10 may include a hinge bracket 120 installed at the lower portion to rotatably couple the door 50 with the main body 10. The hinge bracket 120 may be fixed at the main body 10 such that a portion of the hinge bracket 120 protrudes forward from the main body 10.

In an upper portion of the door 50, a handle 51 may be provided to allow the user to grip the handle 15 to open the door 50. The handle 51 may protrude from a front surface of the door 50.

The handle 51 may include a grip portion 52 which the user can grip with his/her hand, and spacer portions 53 formed at both ends of the grip portion 52 to make the grip portion 52 protrude from the front surface of the door 50 and to allow the user to put his/her hand between the grip portion 52 and the front surface of the door 50.

The handle 51 of the home appliance 1 according to the present disclosure may include a structure fixedly coupled to the door 50. However, the handle 51 may be rotatably coupled to the door 50, and the handle 51 may rotate according to a rotation of the door 50 with respect to the main body 10.

The handle 51 which rotates according to a rotation of the door 50 with respect to the main body 10 may be positioned horizontally when the door 50 is closed, and may be positioned horizontally when the door 50 opens.

The door 50 may include a latch 200 to fix the door 50 when the door 50 is closed. The latch 200 may include a locking hole 221, and the main body 10 may include a catch 250 that is inserted into the locking hole 221 and fixes the door 50 through the latch 200.

The latch 200 may be rotatably installed in the rear portion of the door 50 to rotate when the door 50 rotates with respect to the main body 10. More specifically, when the door 50 is closed, the latch 200 may be at a locking position that is perpendicular to the rear surface of the door 50. When the door 50 is completely opened, the latch 200 may be at an hidden position that is parallel to the rear surface of the door 50

The latch 200 may be included in a link unit 100 accommodated in the door 50 to couple the door 20 with the main body 10. Details about the configurations of the door 50 accommodating the link unit 100 and the latch 200 included in the link unit 100 will be described later.

The display module 60 which displays information about operations of the home appliance 1 and to which the user can input operation commands may be mounted on the machine room cover 40 provided above the front panel 11. The machine room cover 40 may include a control panel 62 to enable the user to operate the home appliance 1.

The display module 60 may include a Liquid Crystal Display (LCD) 61, and the LCD 61 may display electrical information as visual information using a change in transmittance of liquid crystal according to an applied voltage.

The LCD 61 may include a liquid crystal module (not shown) for displaying images, and a light source unit (not shown) for emitting light to the liquid crystal module. The light source unit may be a Light Emitting Diode (LED).

The display module 60 may include a cover panel (not shown) provided on a front surface of the LCD 61, The cover panel may be a protective panel for protecting the LCD 61 or a touch panel for receiving the user's touch commands.

In space between the inner case 11 forming the cavity 20 and the outer case 12 forming the outer appearance of the home appliance 1, various components constituting the home appliance 1 may be installed. Also, a machine room (not shown) for accommodating electrical components to control operations of various devices including the display module 60 may be provided in the space.

A heat insulating material (not shown) for insulating the machine room from the cavity 20 may be provided between the machine room and the cavity 20 to prevent heat from the cavity 20 from being transmitted to the machine room.

The heat insulating material may surround the entire outer surface of the cavity 200, as well as being positioned between the machine room and the cavity 20, in order to prevent heat from the cavity 20 from being transferred to the outside of the home appliance 1.

Figure 5:
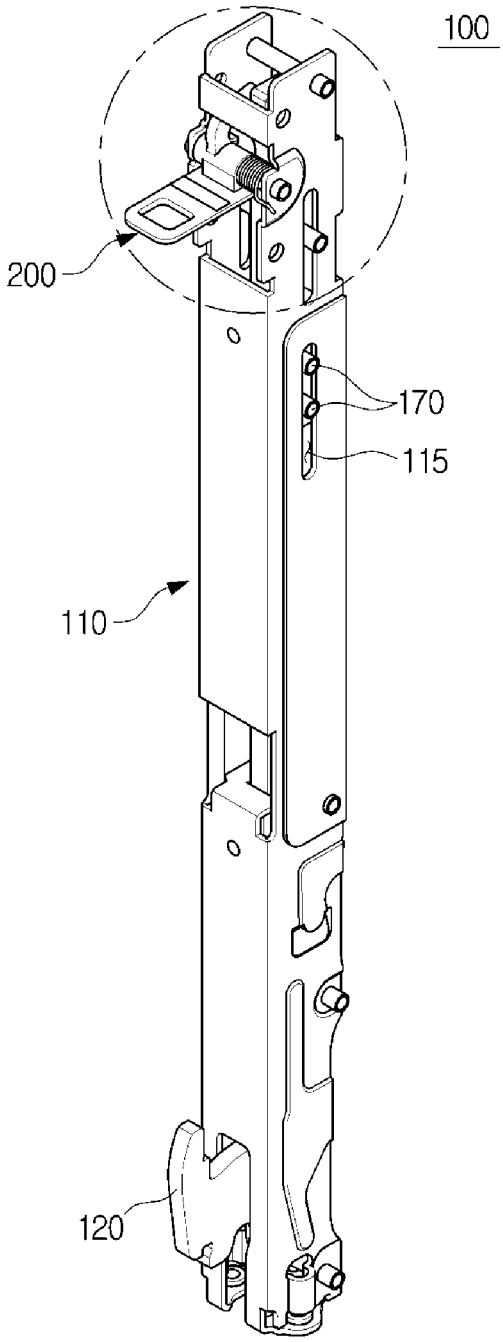
FIG. 5 is a perspective view illustrating the link unit of the home appliance according to the embodiment of the present disclosure.
Figure 6:
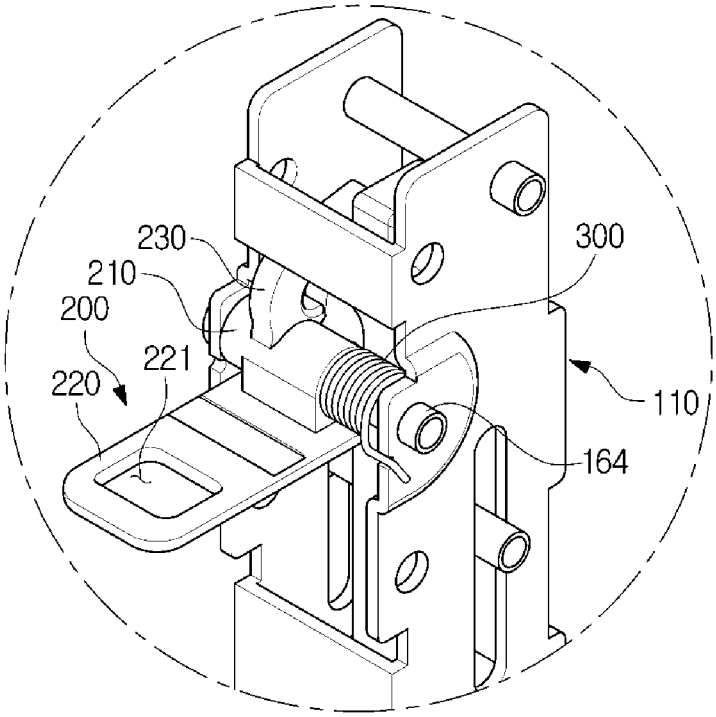
FIG. 6 is an enlarged view illustrating an upper portion of the link unit of the home appliance shown in FIG. 5.
Figure 7:
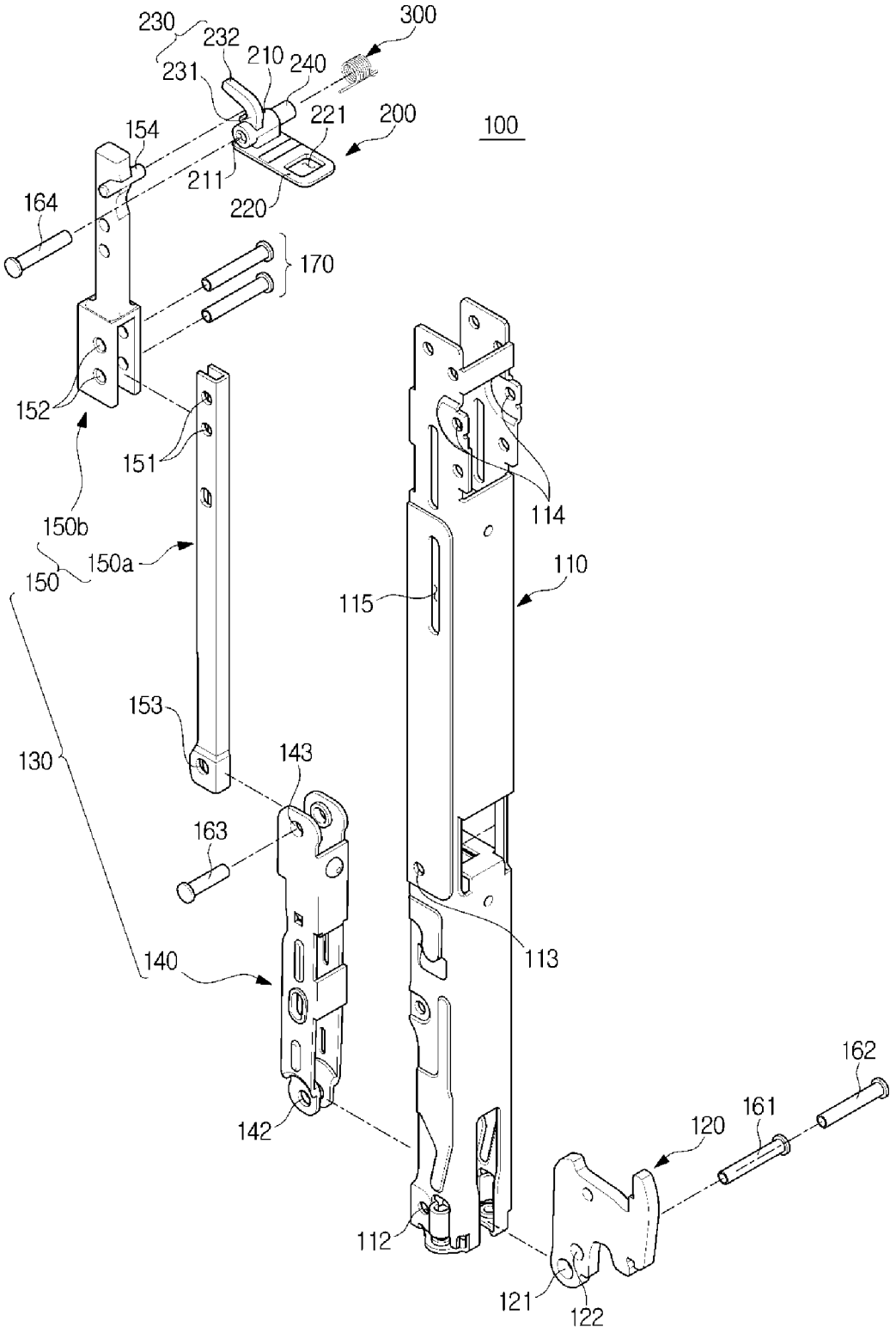
FIG. 7 is an exploded view illustrating the link unit of the home appliance according to the embodiment of the present disclosure.
Figure 8:
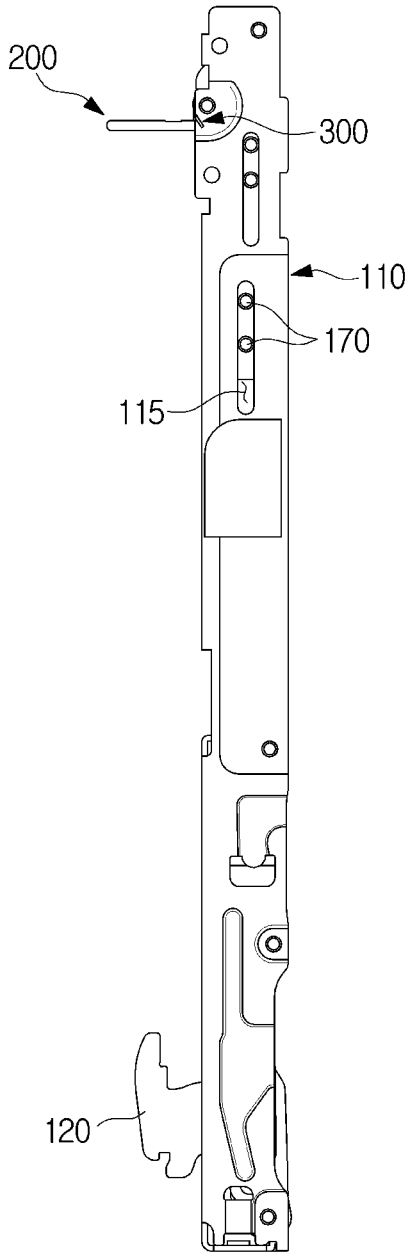
FIG. 8 is a side view illustrating a side portion of the link unit of the home appliance according to the embodiment of the present disclosure.

FIG. 5 is a perspective view illustrating the link unit of the home appliance according to the embodiment of the present disclosure, FIG. 6 is an enlarged view illustrating an upper portion of the link unit of the home appliance shown in FIG. 5, FIG. 7 is an exploded view illustrating the link unit of the home appliance according to the embodiment of the present disclosure, and FIG. 8 is a side view illustrating a side portion of the link unit of the home appliance according to the embodiment of the present disclosure.

As illustrated in FIGS. 5 to 8, the link unit 100 may include a link housing 110, a hinge bracket 120, a link rod 130, a latch 200, and a plurality of joints 161, 162, 163, and 164.

The door 50 may include the link housing 110 fixed to a door body 54. The link housing 110 may receive the link rod 130. The link rod 130 may include a first link rod 140 having one end coupled to the main body 10, and a second link rod 150 having one end coupled to the latch 200.

The link housing 110 may include a first joint hole 112 for coupling with the hinge bracket 120, and a fourth joint hole 114 for coupling with the latch 200.

The link housing 110 may have a guide slot 115 configured to guide a guide protrusion 170. The guide slot 115 may be formed along a longitudinal direction of the link housing 110. The second link rod 150 may be linearly moved with respect to the door 50 by the guide slot 115.

A plurality of guide protrusions 170 may be arranged at predetermined intervals along a longitudinal direction of the guide slot 115 so as to stably move the second link rod 150 linearly. The second link rod 150 may include a first rod 150*a* and a second rod 150*b*.

The first link rod 140 may be rotatably coupled with the second link rod 150. In the home appliance 1 according to the present disclosure, the first rod 150*a* and the second rod 150*b* may be provided separately and coupled by the guide protrusion 170.

However, the first rod 150*a* and the second rod 150*b* may be integrated into one body. The first link rod 140 may include a second joint hole 142 for coupling with the hinge bracket 120, and a first link joint hole 143 for coupling with the first rod 150*a*.

The first rod 150*a* may include a second link joint hole 153 for coupling with the first link rod 140, and a first coupling hole 151 for coupling with the second rod 150*b*.

The second rod 150*b* may include a second coupling hole 152 for coupling with the first rod 150*a*. The second link rod 150 may include a pressing portion 154 to press the latch 200 to rotate it.

The pressing portion 154 may rotate the latch 200 by pressing a leg 230 of the latch 200 when the second link rod 150 linearly moves with respect to the door 50.

The latch 200 may include a cylindrical latch body 210, a locking portion 220 having a locking hole 221 into which the catch 250 formed in the main body 10 is inserted and locked, and the leg 230 that is pressed by the pressing portion 154 of the second link rod 150.

The latch body 210, the locking portion 220, and the leg 230 may be integrated into one body. In the latch body 210, a latch hole 211 for coupling with the door 50 may be formed.

The latch 200 may rotate between a locking position L (see FIG. 9) at which the locking portion 220 is substantially perpendicular to the rear surface of the door 50 and a hidden position H (see FIG. 11) at which the locking portion 220 is substantially parallel to the rear surface of the door 50.

The latch 200 may be at the locking position L when the door 50 is closed, and may be at the hidden position H when the door 50 is fully opened.

The leg 230 may be pressed by the pressing portion 154 of the second link rod 150 when the door 50 is closed so that the second link rod 150 linearly moves upward with respect to the door 50.

With the structure, since the latch 200 is at the hidden position H when the door 50 opens, the user can be prevented from getting caught by the latch 200, and the appearance of the home appliance 1 can be improved.

The home appliance 1 may include four joints 161, 162, 163, and 164 configured to rotate the latch 200 when the door 50 rotates with respect to the main body 10.

Each of the joints 161, 162, 163, and 164 may rotatably couple two members to each other, and form a rotational axis of the two members.

The first joint 161 may rotatably couple the door 50 to the main body 10. The first joint 161 may be inserted into a first hinge joint hole 121 formed in the hinge bracket 120 of the main body 10, and the first joint hole 112 formed in the link housing 110 of the door 50.

The second joint 162 may rotatably couple the first link rod 140 to the main body 10. The second joint 162 may be inserted into a second hinge joint hole 122 formed in the hinge bracket 120 of the main body 10, and the second joint hole 142 formed in the first link rod 140.

The third joint 163 may rotatably couple the first link rod 140 with the second link rod 150. The third joint 163 may be inserted into the first link joint hole 143 formed in the first link rod 140, and the second link joint hole 153 formed in the first rod 150*a*.

The fourth joint 164 may rotatably couple the latch 200 to the door 50. The fourth joint 164 may be inserted into the latch hole 211 formed in the latch 200, and the fourth joint hole 114 formed in the link housing 110 of the door 50.

The locking portion 220 may rotate between the locking position that is perpendicular to the rear surface of the door 50 and the hidden position that is parallel to the rear surface of the door 50. The leg 230 may rotate the locking portion 220 in a first direction, wherein the first direction may be a direction in which the locking portion 220 moves toward the locking position.

The home appliance 1 according to the present disclosure may include an elastic member 300 coupled to the latch 200 and configured to elastically bias the locking portion 220 in a second direction. Here, the second direction may be a direction in which the locking portion 220 moves toward the hidden position.

The elastic member 300 may be coupled to the latch 200, and provide an elastic force to the latch 200 so that the latch 200 can rotate. The elastic member 300 may include a torsion spring 300.

That is, the home appliance 1 according to the present disclosure may use not only the leg 230 pressed by the pressing portion 154 but also the elastic member 300, in order to rotate the locking portion 220 according to a movement of the door 50.

The locking portion 220 may be rotated by the leg 230 when the door 50 is closed, and rotated by the elastic member 300 when the door 50 is opened.

In the home appliance 1 according to the present disclosure, a rotational force of the locking portion 220 in the second direction may be relatively small as compared with the case where only interference between the pressing portion 154 and the leg 230 occurs.

Therefore, although a user's finger opening the door 50 in order to use the home appliance 1 gets caught between the rear surface of the door 50 and the locking portion 220, pressure applied to the user's finger may be relatively low.

The pressing portion 154 may support the leg 230 such that an angle of rotation of the locking portion 220 increases gradually according to a rotation of the door 50.

When the door 50 opens, the pressing portion 154 may support the leg 230 without completely releasing interference with the leg 230, so that the locking portion 220 can rotate gradually according to a rotation of the door 50 without rotating abruptly.

The leg 230 may extend from the periphery of the latch body 210. The latch 200 and the elastic member 300 may be coupled to the link housing 110 by the fourth joint 164.

In order to couple the latch 200 and the elastic member 300 to the link housing 110, the latch hole 211 of the latch 200, the fourth joint hole 114 of the link housing 110, and the elastic member 300 may be aligned coaxially, and then, the fourth joint 164 may be inserted into the latch hole 211, the fourth join hole 114, and the elastic member 300.

The latch 200 may include an elastic member coupling portion 240 with which the elastic member 300 is coupled. The elastic member coupling portion 240 may extend in an axial direction from one end of the latch body 210. The link housing 110 may accommodate the latch 300 and the elastic member 300 coupled with the elastic member coupling portion 240 therein.

In the home appliance 1 according to the present disclosure, the latch hole 211 of the latch 200 and the fourth joint hole 114 of the link housing 110 may be aligned coaxially after the elastic member 300 is seated on the elastic member coupling portion 240 of the latch 200, and then the fourth joint 164 may be inserted into the latch hole 211 and the fourth joint hole 114 to couple the latch 200 to the link housing 110.

Therefore, there is no need to align the elastic member 300 and the latch 200 coaxially in order to couple the elastic member 300 with the latch 200, resulting in an improvement of assembling efficiency and productivity.

Figure 9:
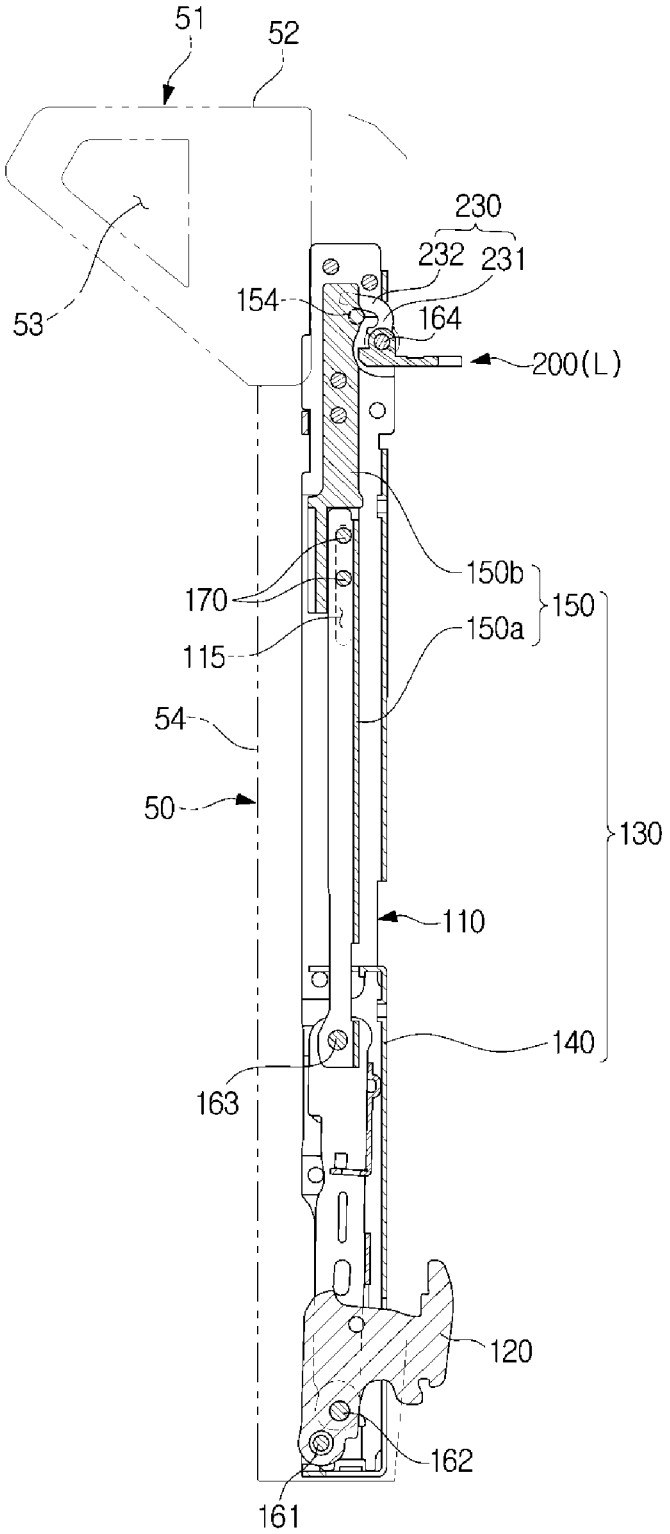
FIG. 9 is a cross-sectional view of the link unit when the door is closed, in the home appliance according to the embodiment of the present disclosure.
Figure 10:
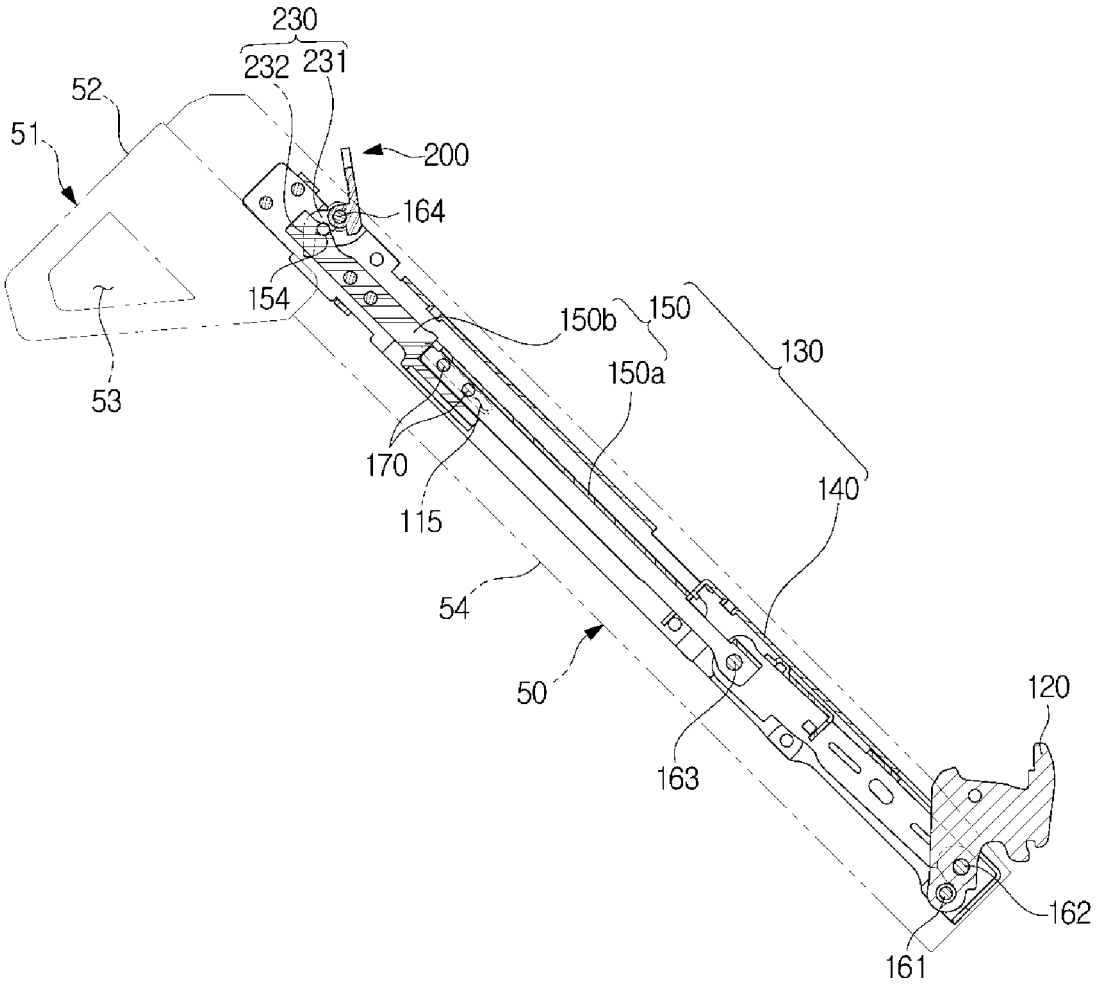
FIG. 10 is a cross-sectional view of the link unit when the door opens, in the home appliance according to the embodiment of the present disclosure.
Figure 11:
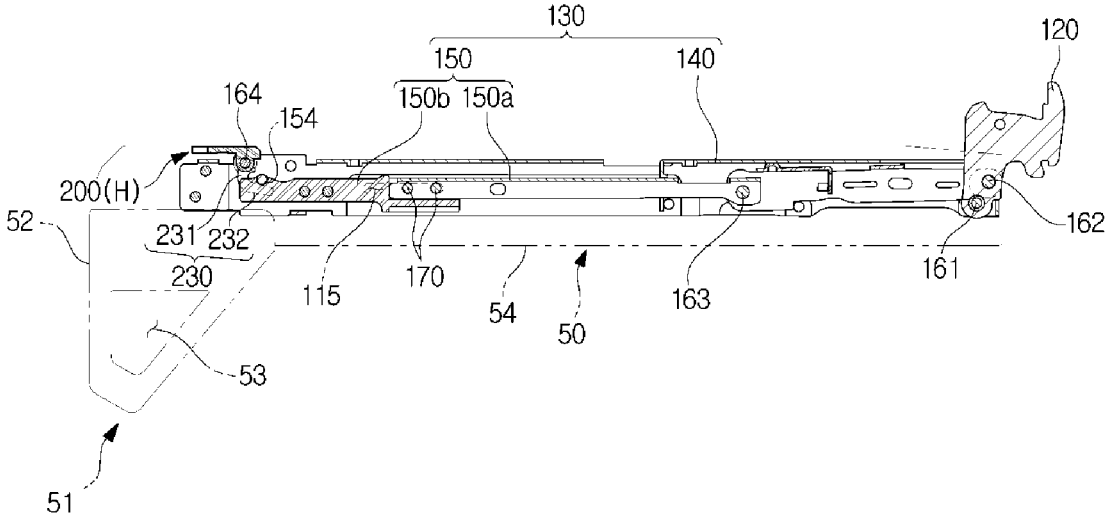
FIG. 11 is a cross-sectional view of the link unit when the door is completely opened, in the home appliance according to the embodiment of the present disclosure.

FIG. 9 is a cross-sectional view of the link unit when the door is closed, in the home appliance according to the embodiment of the present disclosure, FIG. 10 is a cross-sectional view of the link unit when the door opens, in the home appliance according to the embodiment of the present disclosure, and FIG. 11 is a cross-sectional view of the link unit when the door is completely opened, in the home appliance according to the embodiment of the present disclosure.

As illustrated in FIGS. 9 to 11, a position of the first joint 161 may be different from a position of the second joint 162 such that an angle of rotation of the first link rod 140 is larger than an angle of rotation of the door 50.

The first link rod 140 may rotate with respect to the main body 10, the second link rod 150 may linearly move with respect to the door 50 according to the rotation of the first link rod 140, and the latch 200 may rotate according to the linear movement of the second link rod 150.

When the door 50 opens, an angle of rotation of the first link rod 140 may become larger than an angle of rotation of the door 50 due to the difference in position between the first joint 161 and the second joint 162, so that the first link rod 140 may pull the second link rod 150.

If the first link rod 140 pulls the second link rod 150, the second link rod 150 may linearly move downward with respect to the door 50.

As described above, by using the four joints and linearly moving the second link rod 150 with respect to the door 50, the first link rod 140 can smoothly rotate when the door 50 is opened and closed since a length between the second joint 162 and the third joint 163 which is a radius of rotation of the first link rod 140 is shorter than a radius of rotation of the door 50.

Also, since the second link rod 150 linearly moves, it is easy to convert the motion of the second link rod 150 to a rotational motion of the latch 200.

The leg 230 may rotate in the first direction when the locking portion 220 rotates in the second direction. That is, the latch 200 may include the leg 230 configured to limit a rotation of the latch 200 in the second direction by the pressing portion 154, and to allow a rotation of the latch 200 in the first direction.

The leg 230 may include a curved portion 231 extending from the circumferential surface of the leg 230, and a contact portion 232 extending from the curved portion 231.

The leg 230 may include a contact portion 232 that is opposite to the locking portion 220 with respect to the pressing portion 154 to come into contact with the pressing portion 154, and another portion that faces the contact portion 232 and opens with the pressing portion 154 in between.

The locking portion 220 of the home appliance 1 according to the present disclosure may rotate in the second direction by the elastic member 300 so that a rotational force in the second direction may be relatively small as compared with the case of rotating the locking portion 220 in the second direction by pressing the leg 230 with the pressing portion 154.

Therefore, when the user's finger gripping the handle 51 to open the door 50 gets caught between the rear surface of the door 50 and the locking portion 220 rotating toward the hidden position from the locking position, the user can rotate the locking portion 220 rotating in the second direction in the first direction by an external force.

The leg 230 of the home appliance 1 according to the present disclosure is configured such that one end facing the contact portion 232 with the pressing portion 154 in between opens. Therefore, the leg 230 can be prevented from interfering with the pressing portion 154 when the locking portion 220 rotating in the second direction rotates in the first direction.

Accordingly, when the user uses the home appliance 1 including the door 50 according to the present disclosure, it is possible to prevent the user's finger from getting caught between the rear surface of the door 50 and the locking portion 220. Accordingly, it is possible to forestall problems related to the manufacturer's liability for injuries caused by use of the home appliance 1.

Figure 12:
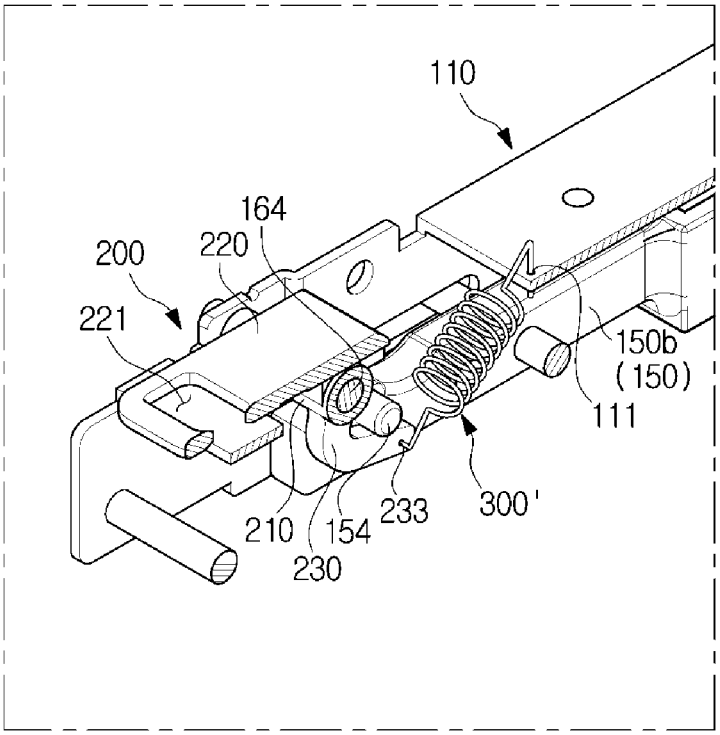
FIG. 12 is a view illustrating a link unit including an elastic member according to another embodiment of the present disclosure.

FIG. 12 is a view illustrating a link unit including an elastic member according to another embodiment of the present disclosure. The same components as those of the embodiment described above will be assigned the same reference numerals, and a detailed description thereof will be omitted.

Referring to FIG. 12, the latch 200 may include the latch body 210, the locking portion 220 including the locking hole 221, and the leg 230, like the embodiment of FIG. 6.

The leg 230 of the latch 200 coupled to the link housing 110 by the fourth joint 164 may be pressed by the pressing portion 154 provided on the second rod **150*b* to rotate the locking portion 220**.

The elastic member 300 may be a tension spring 300'. The leg 230 may include a first spring hole 233 formed at one end, and a second spring hole 111 may be formed in a portion of the link housing 110 disposed near the first spring hole 233.

One end of the tension spring 300' may be inserted into the first spring hole 233, and the other end of the tension spring 300' may be inserted into the second spring hole 111.

The tension spring 300' according to the embodiment of FIG. 12 may elastically bias the locking portion 220 to rotate the locking portion 220 in the second direction, like the torsion spring 300 according to the embodiment of FIG. 6.

However, the positions of the first spring hole 233 and the second spring hole 111 are not limited. That is, the first spring hole 233 and the second spring hole 111 may be formed at any other positions as long as the locking portion 220 can rotate in the second direction by the tension spring 300'.

Instead of the torsion spring 300 according to the embodiment of FIG. 6 and the tension spring 300' according to the embodiment of FIG. 12, the elastic member 300 according to the present disclosure may be configured in various ways as long as it can elastically bias the locking portion 220 to rotate the locking portion 220 in the second direction.

As apparent from the above description, in accordance with the embodiments of the present disclosure, it may be possible to prevent a user from being interfered by the latch when opening the door to use the cavity, since the latch for coupling the door to the main body moves to a position that is parallel to the door when the door is opened.

Also, it may be possible to prevent the user's finger from getting caught between the door and the latch when using the door, since the structure of the latch rotating according to a movement of the door is improved, and the elastic member is coupled with the latch.

Also, since the elastic member coupling portion is provided to couple the elastic member with the latch, it may not be necessary to align the elastic member in the axial direction when the latch is coupled to the link housing by using the joint, resulting in an improvement of assembling efficiency and productivity of the door.

Although a few embodiments of the present disclosure have been shown and described, it is to be understood that the disclosure is not limited to the disclosed embodiments.

It would be appreciated by those skilled in the art that changes may be made in these embodiments without departing from the principles and spirit of the invention, the scope of which is defined in the claims and their equivalents.

What is claimed is:

1. A home appliance comprising:

a main body having a cavity;

a door rotatably coupled to the main body to open or close the cavity;

a latch including a locking portion configured to fix the door to the main body, and a leg configured to rotate the locking portion in a first direction; and an elastic member coupled to the latch, and configured to elastically bias the locking portion in a second direction, wherein the locking portion rotates between a locking position that is perpendicular to a rear surface of the door and a hidden position that is parallel to the rear surface of the door.

2. The home appliance according to claim 1, wherein the latch further comprises an elastic member coupling portion to which the elastic member is coupled, the home appliance further comprising a link housing configured to accommodate the elastic member coupled to the elastic member coupling portion and at least a portion of the latch.

3. The home appliance according to claim 2, wherein the elastic member includes a tension spring.

4. The home appliance according to claim 3, wherein one side of the tension spring is coupled to a first spring hole provided at one end of the leg and the other side of the tension spring is coupled to a second spring hole provided at a portion of the link housing disposed adjacent to the first spring hole.

5. The home appliance according to claim 1, wherein the first direction is a direction in which the locking portion moves toward the locking position, and the second direction is a direction in which the locking portion moves toward the hidden position.

6. The home appliance according to claim 1, wherein the elastic member includes a torsion spring.

7. The home appliance according to claim 1, further comprising a link rod configured to linearly move with respect to the door and including a pressing portion configured to press and rotate the latch.

8. The home appliance according to claim 7, wherein the pressing portion supports the leg such that an angle of rotation of the locking portion increases gradually according to a rotation of the door.

9. The home appliance according to claim 7, wherein the link rod further comprises a first link rod having one side coupled to the main body and a second link rod having one side coupled to the latch, and the other side of the first link rod is rotatably coupled with the other side of the second link rod.

10. The home appliance according to claim 9, wherein the first link rod rotates with respect to the main body, the second link rod linearly moves with respect to the door according to the rotation of the first link rod, and the latch rotates according to the linear movement of the second link rod.

11. The home appliance according to claim 9, further comprising:

a first joint rotatably coupling the door to the main body;

a second joint rotatably coupling the first link rod to the main body;

a third joint rotatably coupling the second link rod to the first link rod; and a fourth joint rotatably coupling the latch to the door.

12. The home appliance according to claim 11, wherein a position of the first joint is different from a position of the second joint such that an angle of rotation of the first link rod is larger than an angle of rotation of the door.

13. The home appliance according to claim 1, wherein the locking portion is rotated by the leg when the door is closed, and is rotated by the elastic member when the door is opened.

14. The home appliance according to claim 1, wherein the leg is configured such that the locking portion is rotatable in the first direction while rotating in the second direction.

15. A home appliance comprising:

a main body having a cavity;

a door configured to open or close the cavity; and a link unit accommodated in the door, and configured to rotatably couple the door to the main body, wherein the link unit comprises:

a latch including a locking portion configured to fix the door to the main body, and to rotate according to a rotation of the door with respect to the main body; and a link rod configured to be linearly movable and including a pressing portion configured to press and rotate the latch, wherein the latch comprises a leg configured to allow a rotation of the latch in a first direction and to restrict a rotation of the latch in a second direction by the pressing portion, wherein the locking portion rotates between a locking position that is perpendicular to a rear surface of the door and a hidden position that is parallel to the rear surface of the door.

16. The home appliance according to claim 15, wherein the link unit further comprises an elastic member configured to elastically bias the latch to rotate the latch in the second direction.

17. The home appliance according to claim 16, wherein the elastic member is coupled to the latch, and disposed in a link housing receiving the link rod together with the latch.

18. A home appliance comprising:

a main body having a cavity;

a door rotatably coupled to the main body to open or close the cavity;

a latch coupled to the door, and configured to rotate according to a rotation of the door with respect to the main body; and an elastic member coupled to the latch, and configured to transmit an elastic force to the latch so as to rotate the latch, wherein the latch comprises:

a latch body including a latch hole through which the latch is coupled to the door, a locking portion configured to fix the door to the main body, an elastic member coupling portion extending in an axial direction from one end of the latch body, and coupled with the elastic member, and a leg extending from a periphery of the latch body.

19. The home appliance according to claim 18, further comprising a link rod including a pressing portion configured to press the latch to rotate the locking portion, wherein the leg includes a contact portion that is opposite to the locking portion with respect to the pressing portion to be in contact with the pressing portion, and another portion that faces the contact portion and opens with the pressing portion in between.

* * * * *